US008950133B2

(12) United States Patent
Hansort

(10) Patent No.: US 8,950,133 B2
(45) Date of Patent: Feb. 10, 2015

(54) BRACKET AND AN ARRANGEMENT FOR SUPPORTING A PRECAST SLAB ELEMENT OF CONCRETE ON A PRECAST STRUCTURE ELEMENT OF CONCRETE

(71) Applicant: Peikko Group Oy, Lahti (FI)

(72) Inventor: Marinus Hansort, St Pete Beach, FL (US)

(73) Assignee: Peikko Group Oy, Lahti (FI)

( * ) Notice: Subject to any disclaimer, the term of this patent is extended or adjusted under 35 U.S.C. 154(b) by 0 days.

(21) Appl. No.: 13/872,656

(22) Filed: Apr. 29, 2013

(65) Prior Publication Data

US 2014/0318059 A1 Oct. 30, 2014

(51) Int. Cl.
*E04B 1/21* (2006.01)
*E04B 1/41* (2006.01)

(52) U.S. Cl.
CPC ..... *E04B 1/4121* (2013.01)
USPC ..... 52/283; 52/702; 52/704; 52/707

(58) Field of Classification Search
USPC ..... 52/283, 702, 704, 707, 223.8, 223.11, 52/223.9, 223.13, 698, 125.4, 251, 289; 403/408.1, 364
See application file for complete search history.

(56) References Cited

U.S. PATENT DOCUMENTS

| | | | | |
|---|---|---|---|---|
| 3,733,757 | A * | 5/1973 | Scott | 52/105 |
| 4,903,448 | A * | 2/1990 | Compton | 52/252 |
| 4,982,537 | A * | 1/1991 | Matikainen | 52/251 |
| 5,548,939 | A * | 8/1996 | Carmical | 52/707 |
| 5,862,634 | A * | 1/1999 | Berger et al. | 52/73 |
| 6,679,017 | B2 * | 1/2004 | Woodruff et al. | 52/283 |
| 7,213,376 | B2 * | 5/2007 | Pulkkanen et al. | 52/283 |
| 8,011,147 | B2 * | 9/2011 | Hanlan | 52/252 |
| 2004/0050012 | A1 * | 3/2004 | Pulkkanen et al. | 52/702 |
| 2004/0065030 | A1 * | 4/2004 | Zambelli et al. | 52/223.13 |
| 2008/0060293 | A1 | 3/2008 | Hanlon | |
| 2008/0279620 | A1 * | 11/2008 | Berg | 403/178 |
| 2009/0165413 | A1 * | 7/2009 | Berg | 52/327 |

FOREIGN PATENT DOCUMENTS

| | | | | |
|---|---|---|---|---|
| DE | 43 13 895 | A1 | 11/1994 | |
| DE | 19952594 | A1 * | 5/2001 | E04B 1/38 |
| FI | 100417 | B1 | 11/1997 | |

(Continued)

OTHER PUBLICATIONS

Aug. 22, 2014 International Search Report issued in International Application No. PCT/FI2014/050302.

*Primary Examiner* — Robert Canfield
*Assistant Examiner* — Babajide Demuren
(74) *Attorney, Agent, or Firm* — Oliff PLC

(57) ABSTRACT

A bracket that supports a precast structural element of concrete has: a first support part that casts at least partly into a support element of concrete; a bracket part movably fastened to the first support part by bolts, the bracket part having first through holes which are penetrated by the bolts, and the first support part having threaded holes for the bolts, the bolts having an outer diameter that is smaller than the inner diameter of the through holes in the bracket part to fasten the bracket part in various positions with respect to the first support part; and a second support part to cast at least partly into a precast structural element of concrete and to support on the bracket part. The second support part has a support plate having a slot with a second support surface for support on a first support surface of the bracket part.

18 Claims, 10 Drawing Sheets

(56) References Cited

FOREIGN PATENT DOCUMENTS

| | | | |
|---|---|---|---|
| FI | 5919 U1 | | 8/2003 |
| WO | WO 02/33185 | A1 | 4/2002 |
| WO | WO 2004/031498 | A1 | 4/2004 |
| WO | WO 2007/043892 | | 4/2007 |

* cited by examiner

BRACKET AND AN ARRANGEMENT FOR SUPPORTING A PRECAST SLAB ELEMENT OF CONCRETE ON A PRECAST STRUCTURE ELEMENT OF CONCRETE

FIELD OF THE INVENTION

The invention relates to bracket for supporting a precast structural element of concrete such as a precast slab element of concrete or a precast beam element of concrete on a precast support element of concrete such as on a precast wall element of concrete or on a precast pillar element of concrete.

The invention also relates to an arrangement for supporting a precast slab element of concrete such as a TT-slab element of concrete on at least one precast support element of concrete such as on a precast wall element of concrete.

Currently TT-slab element (also called "double T element") for buildings /parking structures are places on steel or concrete ledges, formed edges and concrete/steel corbels, so that the bottom of the TT-slab element is resting on a flat steel/concrete surface to carry the weight and live load of a TT-slab element. Edges, ledges and corbels are formed on columns and walls and are sticking out of the surface of the structural columns and walls and are in the way when TT-slab element are placed in position to form a floor or roof. When the TT-slab element is placed in position, the TT-slab element is resting on a small steel/concrete surface and needs to be connected to the column and walls as soon as possible to secure the structural integrity of the building In many cases the TT-slab element where touched, moved or columns or walls moved and TT-slab element slipped of the concrete edge, corbels where the bottom of the TT-slab element was resting on, with catastrophic impact. Build on corbels for walls or columns are available in the market, as well as hanging corbels that stick out from the TT-slab element, but the TT-slab element is still able to slip of if not secured properly. TT-slab elements are hard to place with sticking out corbels or edges.

Various brackets as well as methods and arrangements for supporting precast construction elements of concrete on supporting elements of concrete are known in the art.

Publication WO 02/33185 relates to a bracket for supporting a structural element, such as a precast concrete beam, on a concrete pile or similar support structure in a building. The bracket comprises a first support part which is cast at least partly into the concrete pile. The first support part comprises a bracket part for supporting the structural element so that the structural element bears against the concrete pile. The bracket part is movably fastened to the first support part, which is cast at least partly into the concrete pile, such that the position of the bracket part with regard to the concrete pile can be changed.

Publication WO 2004/031498 relates to a console for supporting a structural member, such as a concrete element, on a concrete column or a corresponding supporting structure of a building. The console comprises a supporting member, which is at least partly cast in the concrete column or fastened to a corresponding supporting structure of the building. The supporting member, in turn, comprises a console plate, on which the structural member can be supported in such a manner that the structural member is supported on the supporting structure, whereby the upper surface of the console plate has a substantially semi-circular shape.

OBJECTIVE OF THE INVENTION

An object of the invention is to provide an improved bracket that is especially suitable for supporting a precast slab element of concrete such as a TT-slab element of concrete on at least one precast pillar element of concrete or on a precast wall element of concrete. Another object of the invention is to provide an improved arrangement for supporting a precast slab element of concrete such as a TT-slab element of concrete on at least one precast support element of concrete such as on a precast wall element of concrete.

SHORT DESCRIPTION OF THE INVENTION

Especially when mounting precast slab element of concrete in the form of TT-slab elements of concrete, the arrangement provides for several benefits. Traditionally TT-slab elements of concrete have been mounted so that the vertical flanges of a TT-slab element rest on a support structures of concrete. This means that supports must be provided for preventing the TT-slab elements from sliding on the support structures of concrete and/or from falling down from the support structures of concrete. The arrangement provides therefore for easier mounting and improved safety during mounting.

LIST OF FIGURES

In the following the invention will described in more detail by referring to the figures of which FIG. 1 shows a precast TT-element of concrete that is provided with two brackets, FIG. 2 shows the joint shown in FIGS. 3 and 4 as cut along line A-A in FIG. 4, FIG. 3 shows in partly cut view joints between two precast wall elements of concrete, FIG. 4 shows in partly cut view joints between two precast wall elements of concrete, FIG. 5 shows a bracket according to one embodiment, FIG. 6 shows the bracket shown in FIG. 5 as seen from one end, FIG. 7 shows the bracket shown in FIG. 5 as seen from the opposite end FIG. 8 shows the bracket shown in FIG. 5 as seen from one side, FIG. 9 shows the first support element of the bracket shown in FIG. 5 in a state where a bracket part and a stopper part has been fastened to the first support element, FIG. 10 shows the first support element of the bracket shown in FIG. 5 as seen from one end, FIG. 11 shows the first support element of the bracket shown in FIG. 5 as seen from one side, FIG. 12 shows the first support element of the bracket shown in FIG. 5 as seen from the opposite end, FIG. 13 shows the bracket part of the bracket shown in FIG. 5 as seen from one end, FIG. 14 shows the bracket part of the bracket shown in FIG. 5 as seen from the opposite end, FIG. 15 shows the bracket part of the bracket shown in FIG. 5 as seen from one side, FIG. 16 shows the first support element of the bracket shown in FIG. 5 in a state where a bracket part and a stopper part has been fastened to the first support element, FIG. 17 shows the first support element of the bracket shown in FIG. 5 as seen from one end, FIG. 18 shows the first support element of the bracket shown in FIG. 5 as seen from the opposite end, FIG. 19 shows the first support element of the bracket shown in FIG. 5 as seen from one side, and FIG. 20 shows the first support element of the bracket shown in FIG. 5 as cut along line B-B in FIG. 18 stopper part 31.

DETAILED DESCRIPTION OF THE INVENTION

Figure 1:
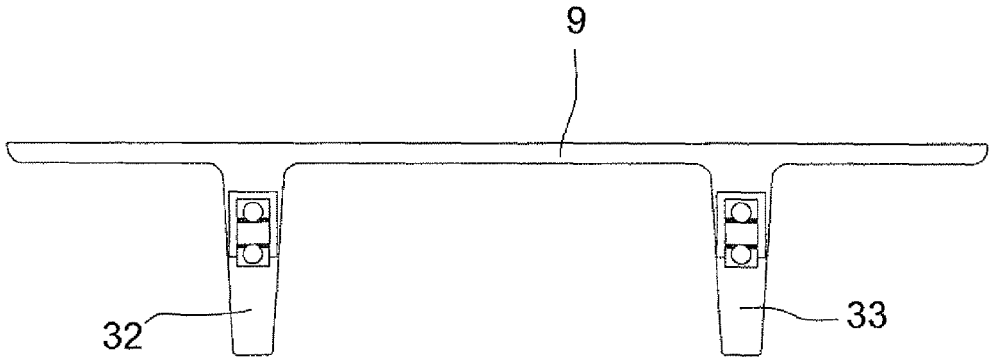
FIGS. 1 to 4 shows an example of an arrangement for supporting a precast slab element of concrete such as a TT-slab element of concrete on at least on precast support element of concrete such as on a precast wall element of concrete.

First the bracket for supporting a precast structural element of concrete such as a precast slab element of concrete or a precast beam element of concrete on a precast support element (3) of concrete such as on a precast wall element of concrete or on a precast pillar element of concrete and some preferred embodiments and variants of the bracket will be described in greater detail.

The bracket 1 comprises a first support part 2 for casting at least partly into a support element 3 of concrete.

The bracket 1 comprises additionally a bracket part 4 movable fastened to the first support part 2 by means of bolts 5. The bracket part 4 comprises first through holes 6 which are penetrated by the bolts 5. The first support part 2 comprises threaded holes 7 for co-operation with threads of the bolts 5. The bolts 5 have an outer diameter that is smaller than the inner diameter of the through holes in the bracket part 4 for allowing fastening the bracket part 4 in various positions with respect to the first support part 2.

The bracket 1 comprises additionally a second support part 8 for casting at least partly into precast structural element 9 of concrete and for supporting on the bracket part 4.

The second support part 8 comprises a support plate 10 having a slot 11 having a second support surface 12 for supporting the second support part 8 on a first support surface 13 of the bracket part 4.

The first support surface 13 and the second support surface 12 have preferably, but not necessarily, at least partly curved configuration as is shown in the embodiments shown in the figures.

The bracket part 4 comprises preferably, but not necessarily, a first preformed surface 14 for cooperation with a second preformed surface 15 of the first support part 2 for promoting fastening of the bracket part 4 to the first support part 2 as is shown in the embodiments shown in the figures.

The bracket 1 comprises preferably, but not necessarily, a stopper part 31 for holding the second support part 8 on the bracket part 4. Such stopper part is provided with second through holes 16 penetrated by the bolts 5 by means of which the bracket part 4 is fastened to the first support part 2 so that the bracket part 4 is situated between the stopper part 31 and the first support part 2 as is shown in the embodiments shown in the figures. The stopper part 31 may be a part fastened to the bracket part 4 or a part of the bracket part 4. The cross-sectional area of the stopper part 31 in a plane normal to a central axis of a second hole is preferably, but not necessarily, larger than the cross-sectional area of the bracket part 4 in a plane normal to a central axis of a first hole as is shown in the embodiments shown in the figures.

The cross-sectional area of the bracket part 4 in a plane normal to a central axis of a first hole may correspond to the form of the slot 11 in the support plate 10 of the second support part 8.

The second support part 8 is preferably, but not necessarily, provided with first anchoring means 29.

The second support part 8 may, as in the embodiment shown in the figures, comprise two parallel identical plate parts 17. In the embodiment shown in the figures each plate part 17 have a rectangular shape and a first end side 18, a second end side 19, a first side 20, a second side 21, a first side surface 22, and a second side surface 23. In the embodiment shown in the figures the support plate 10 is fastened to the first end side 18 of each plate part 17. In the embodiment shown in the figures the second support part 8 is partly open between the two parallel identical plate parts 17 to create a kind of beam of open cross section. If the second support part 8 comprise two parallel identical plate parts 17, as shown in the figures, the second support part 8 may comprise at least one first anchoring means 29 in the form of a U-shaped anchoring member fastened between the plate parts 17 so that said U-shaped anchoring member is fastened to the first side surface 22 of each plate part 17 and so that said at least one U-shaped anchoring member extends beyond the first side surface 22 of each plate part 17 from the structure formed by the plate parts 17.

If the second support part 8 comprises two parallel identical plate parts 17, as shown in the figures, the second support part 8 may, as shown in the figures, comprise a second plate part 24 for connecting said two parallel identical plate parts 17. Such second plate part 24 is fastened to the first side 20 of each plate part 17, and which second plate part 24 having rectangular or square shape. Such second plate part 24 may be situated at the opposite end of the second support part 8 in comparison to the support plate 10, as is shown in the figures.

If the second support part 8 comprises two parallel identical plate parts 17, as shown in the figures, the second support part 8 may, as shown in the figures, comprise a third plate part 26 for connecting said two parallel identical plate parts 17, which third plate is fastened to the plate parts 17 between the first side surface 22s of the two parallel plate parts 17. Such third plate part 26 may have a rectangular or square shape.

The second support part 8 comprises preferably, but not necessarily, as shown in the figures, a housing structure 25 for providing a space for the bracket part 4 in the second support part 8. A purpose of the housing structure 25 is to ensure that a space for the bracket part 4 is provided in the second support part 8 also after that the second support part 8 has been at least partly casted into a precast structural element of concrete.

The first support part 2 of the bracket 1 comprises preferably, but not necessarily, a plate member 27 and a profile member 28 attached to the plate member 27 for anchoring the first support part 2 to the precast support element 3 of concrete. The treaded holes are preferably, but not necessarily, as shown in the figures, provided in the plate member 27.

The first support part 2 of the bracket 1 is preferably, but not necessarily, provided with at least one second anchoring means 30 for anchoring the first support part 2 to the precast support element 3 of concrete. In the figures the second anchoring means 30 are in the form of studs with enlarged heads.

The first support part 1, the second support part 2, and the bracket part 4 are preferably, but not necessarily, made of steel.

In the following the arrangement for supporting a precast slab element of concrete such as a TT-slab element of concrete on at least one precast support element 3 of concrete such as on a precast wall element of concrete and some preferred embodiments and variants of the arrangement will be described in greater detail.

In the arrangement an end of the precast slab element may be supported on one or on several precast support elements of concrete. It is for example possible that an end of the precast slab element may be supported on several precast pillar elements of concrete. It is for example possible that an end of the precast slab element may be supported on one wall element of concrete.

In the arrangement an end of the precast slab element is supported on said at least one precast support element 3 by means of at least two brackets 1 located at a distance from each other.

In the arrangement each of the brackets 1 comprises a first support part 2 casted at least partly into a precast support element 3.

In the arrangement each of the brackets 1 comprises a bracket part 4 movable fastened to the first support part 2 by means of bolts 5 so that the bracket part 4 is at least partly located outside the precast support element 3, wherein the bracket part 4 comprises first through holes 6 which are penetrated by the bolts 5 and wherein the first support part 2 comprises threaded holes 7 for co-operation with threads of the bolts 5, wherein the bolts 5 having an outer diameter that is smaller than the inner diameter of the through holes in the bracket part 4 for fastening the bracket part 4 in various positions with respect to the first support part 2.

In the arrangement each of the brackets 1 comprises a second support part 8 casted at least partly into precast slab element.

In the arrangement, in each of the brackets 1, the second support part 8 comprises a support plate 10 having a slot 11 having a second support surface 12 by means of which the second support part 8 is supported on a first support surface 13 of the bracket part 4 for supporting the precast slab element on the precast support element 3.

Said at least two brackets 1 are preferably, but not necessarily, located at essentially the same vertical height.

Figure 2:
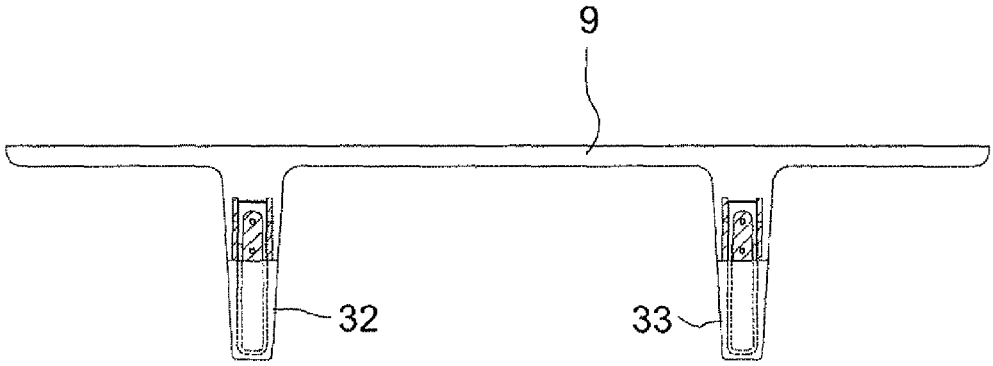
Figure 3:
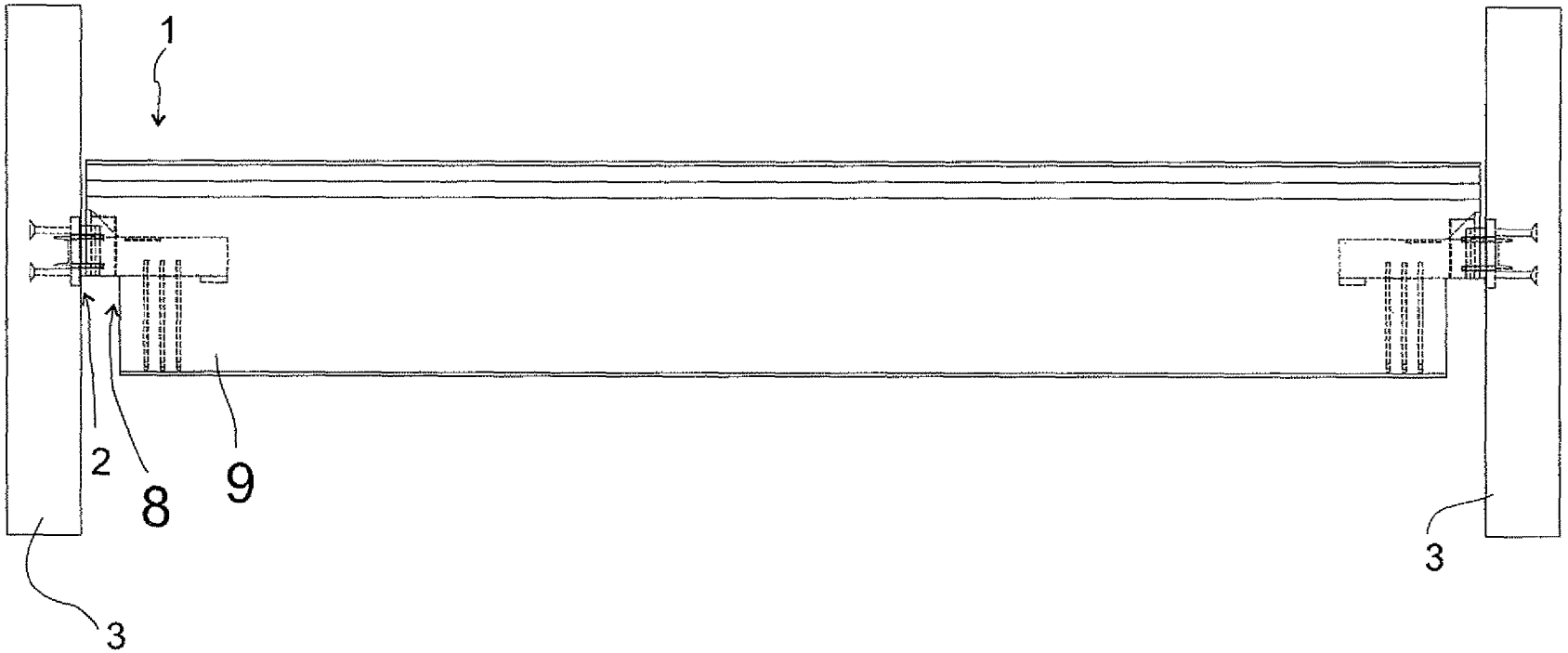
Figure 4:
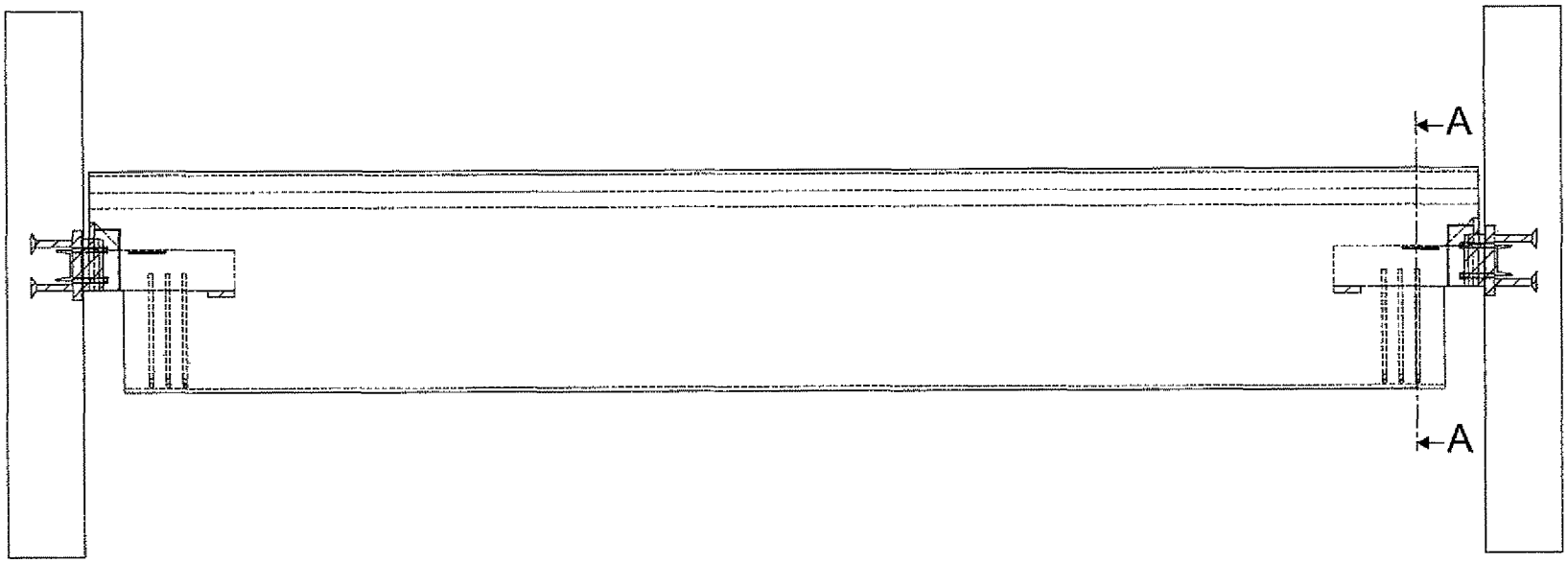
Figure 5:
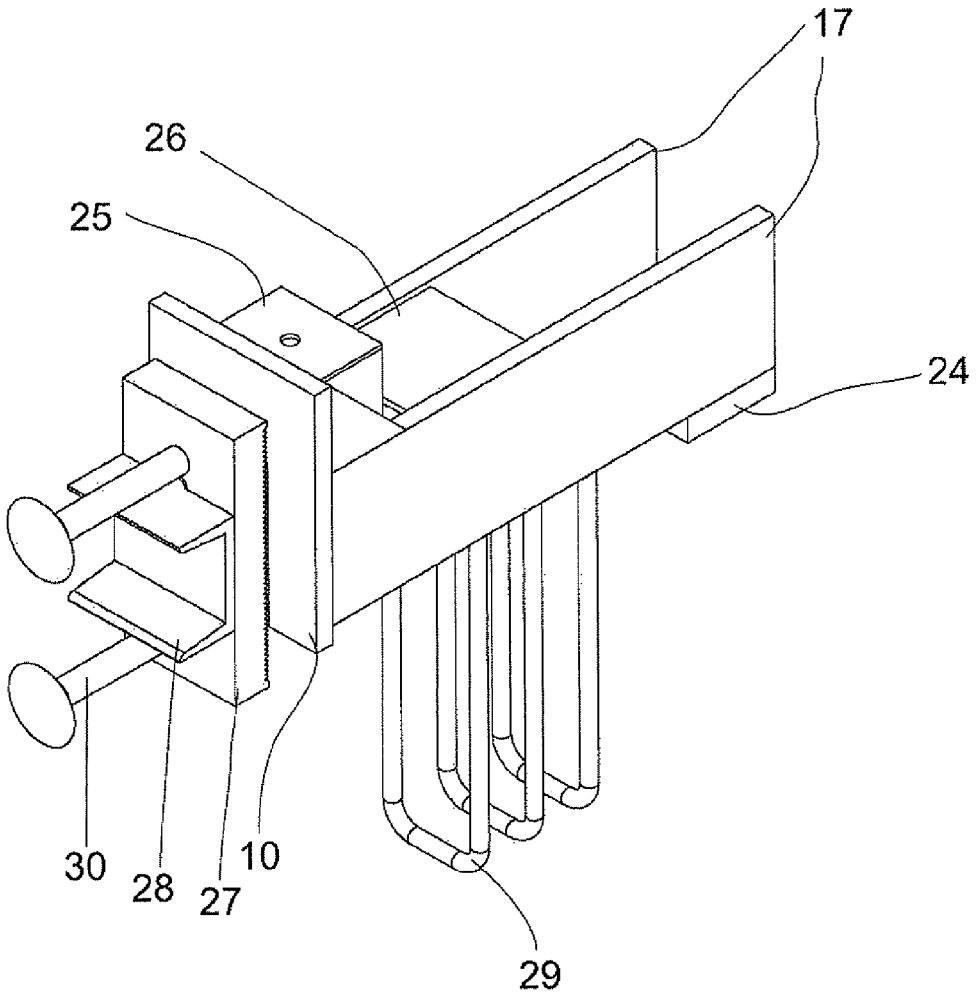
FIGS. 5 to 9 shows an example of a bracket for supporting a precast structural element of concrete such as a precast slab element of concrete or a precast beam element of concrete on a precast support element of concrete such as on a precast wall element of concrete or on a precast pillar element of concrete.
Figure 6:
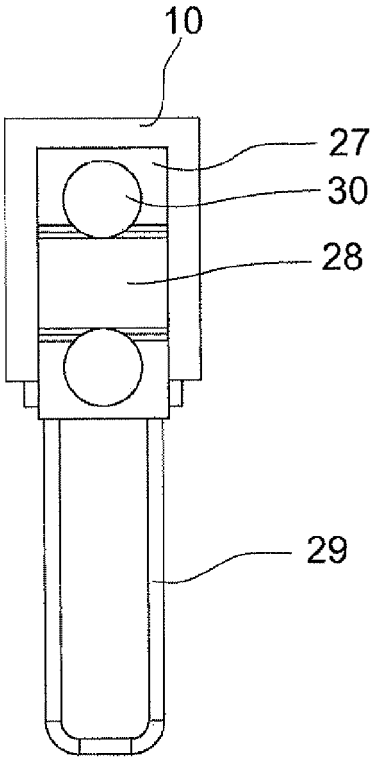
Figure 8:
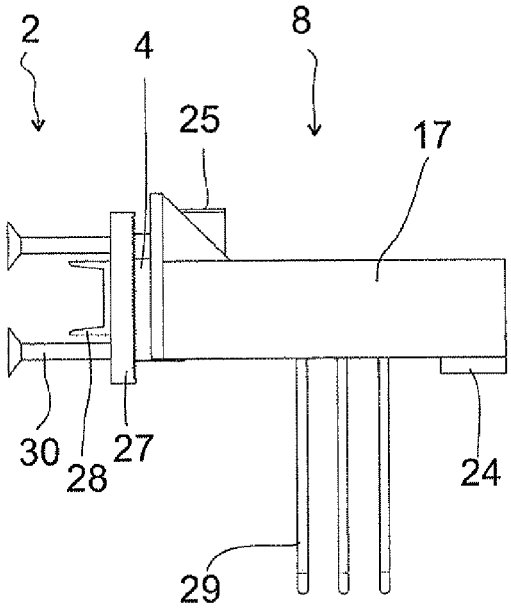
Figure 7:
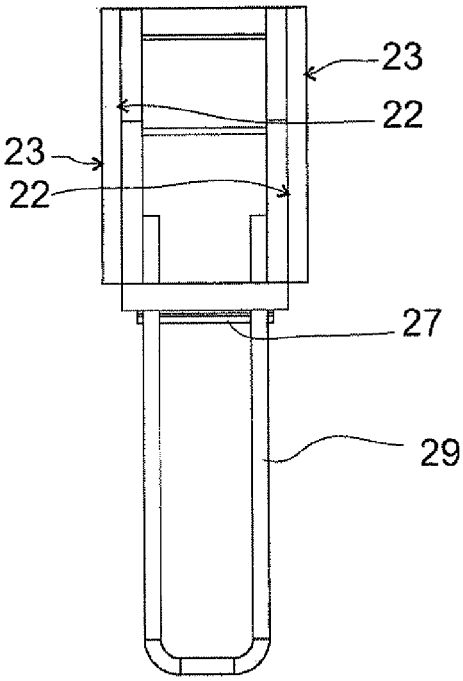
Figure 9:
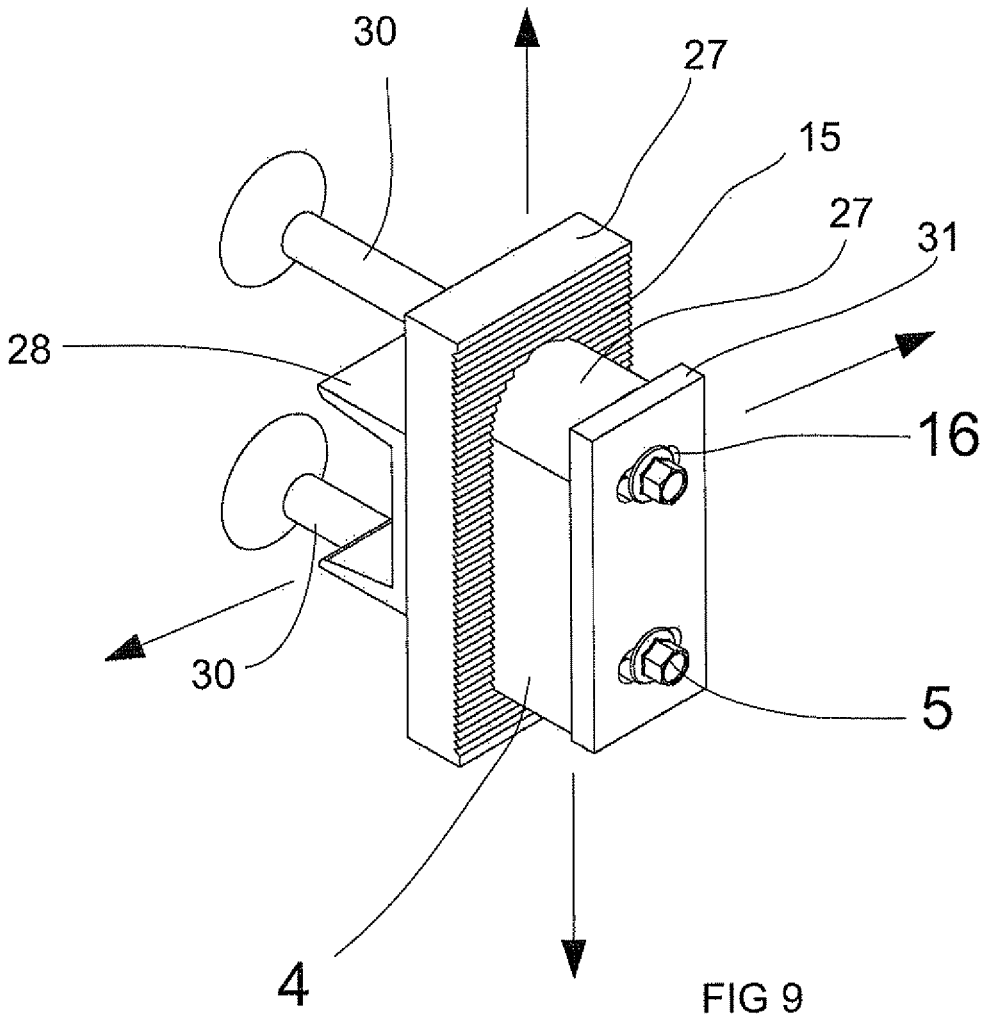
Figure 10:
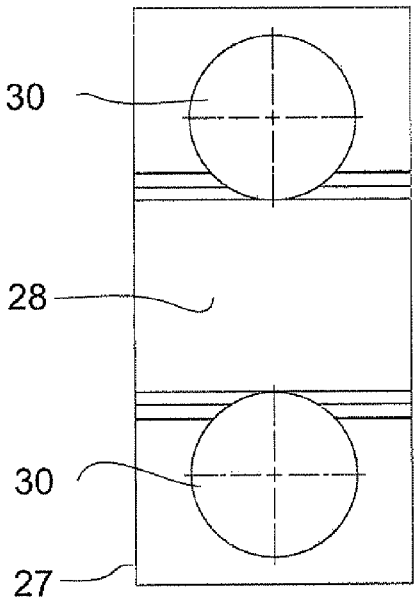
Figure 11:
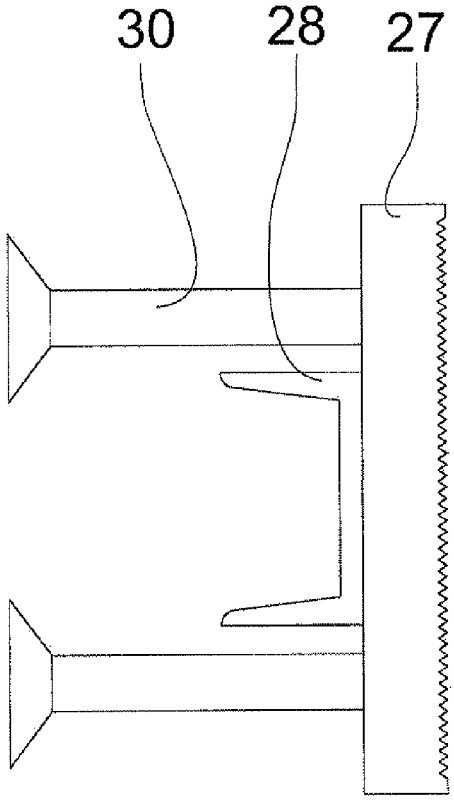
Figure 12:
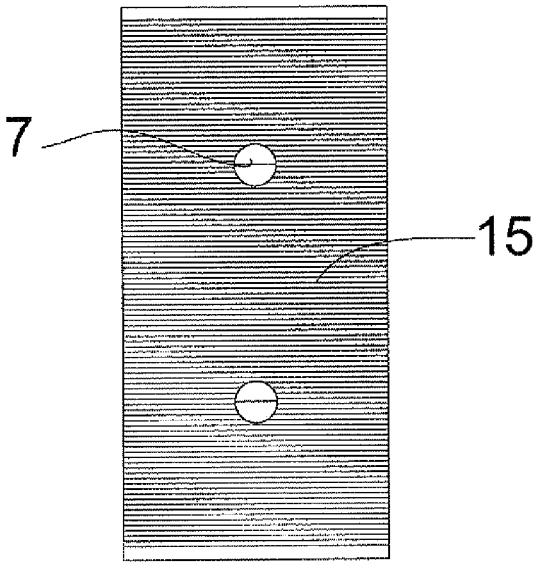
Figure 13:
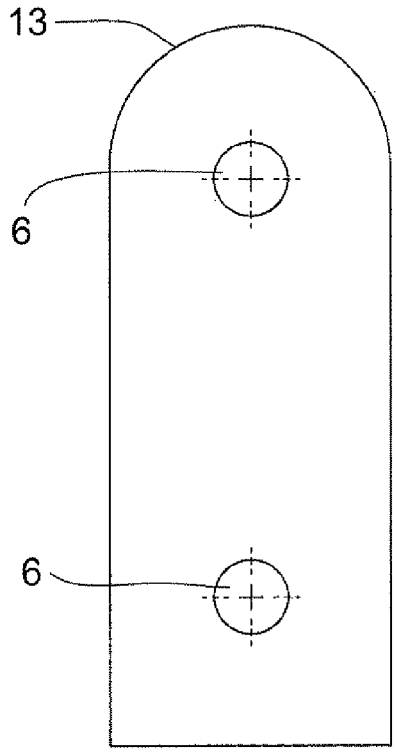
Figure 14:
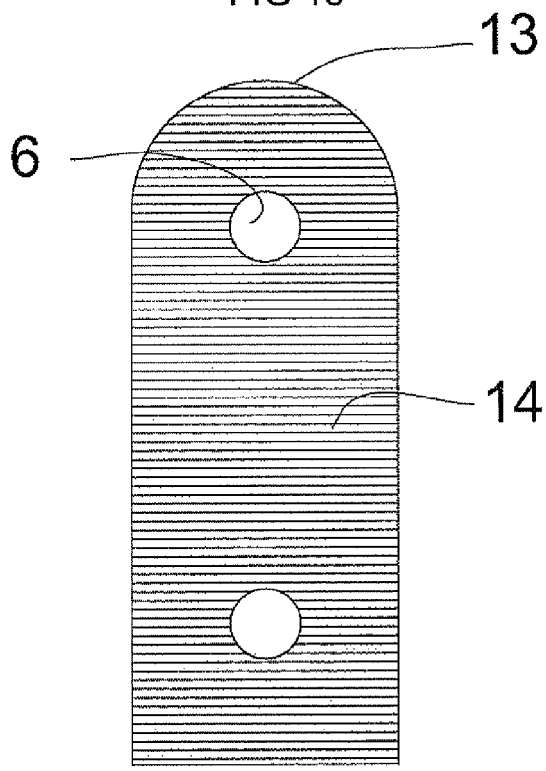
Figure 15:
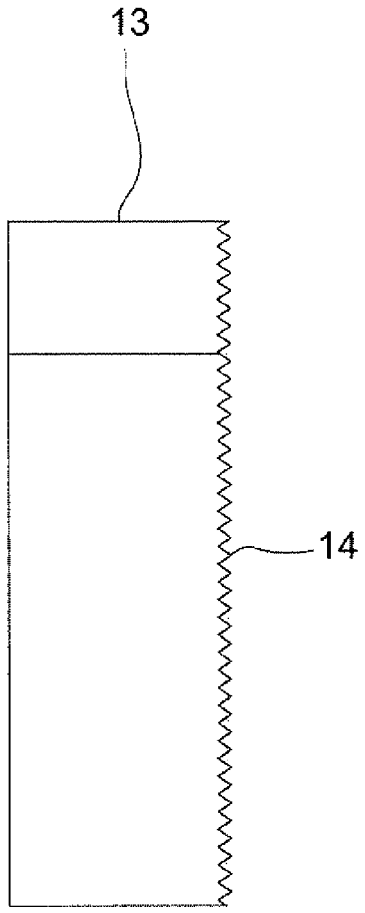
Figure 16:
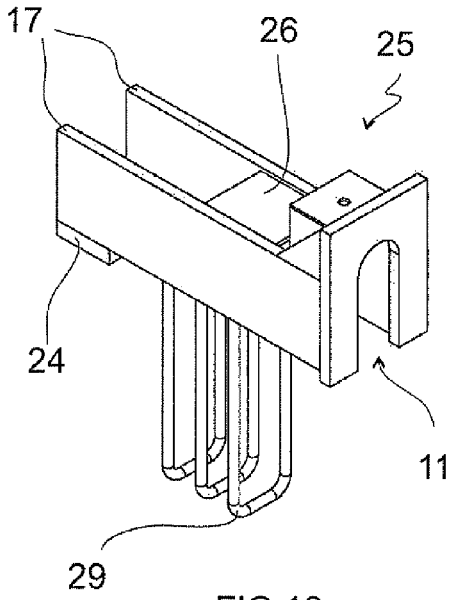
Figure 17:
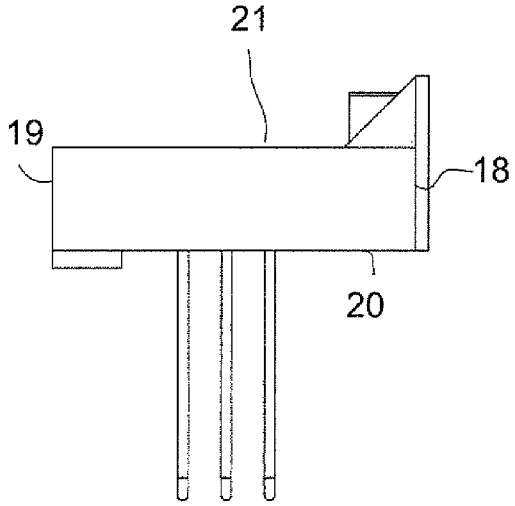
Figure 18:
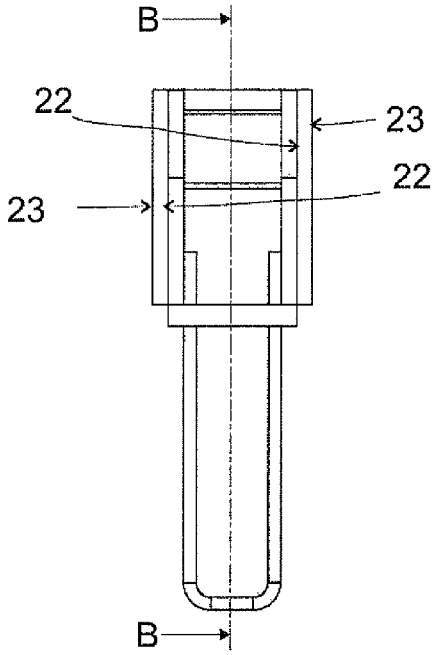
Figure 19:
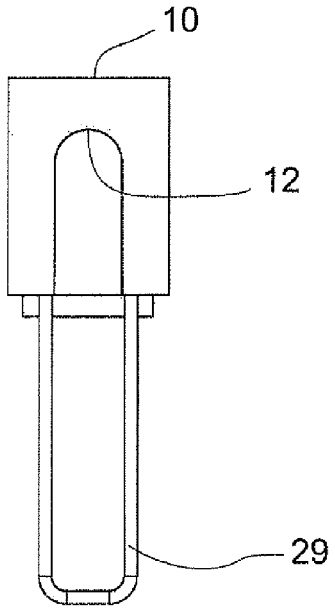
Figure 20:
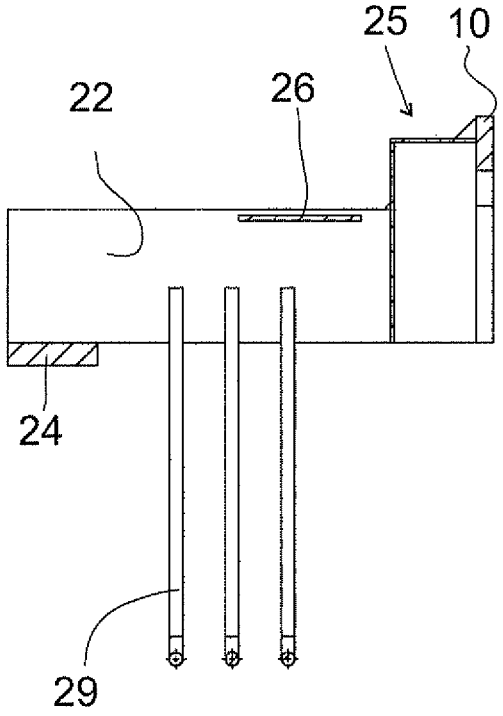

If the precast slab element is provided with a first vertical flange 32 and with a second vertical flange 33, such as shown in FIGS. 1 to 4, where the precast slab element is a TT-slab element of concrete, a second support part 8 is preferably, but not necessarily, casted at least partly into the first vertical flange 32 of the precast slab element and a second support part 8 is preferably, but not necessarily, casted at least partly into the second vertical flange 33 of the precast slab element.

In the arrangement the first support surface 13 and the second support surface 12 of at least one bracket 1 of said at least two brackets 1 have preferably, but not necessarily, at least partly curved configuration as is shown in the embodiments shown in the figures.

In the arrangement the bracket part 4 of at least one bracket 1 of said at least two brackets 1 comprises preferably, but not necessarily, a first preformed surface 14 for cooperation with a second preformed surface 15 of the first support part 2 for promoting fastening of the bracket part 4 to the first support part 2 as is shown in the embodiments shown in the figures.

In the arrangement at least one bracket 1 of said at least two brackets 1 comprises preferably, but not necessarily, a stopper part 31 for holding the second support part 8 on the bracket part 4. Such stopper part 31 is provided with second through holes 16 penetrated by the bolts 5 by means of which the bracket part 4 is fastened to the first support part 2 so that the bracket part 4 is situated between the stopper part 31 and the first support part 2 as is shown in the embodiments shown in the figures. The stopper part 31 may be a part fastened to the bracket part 4 or a part of the bracket part 4. The cross-sectional area of the stopper part 31 in a plane normal to a central axis of a second hole is preferably, but not necessarily, larger than the cross-sectional area of the bracket part 4 in a plane normal to a central axis of a first hole as is shown in the embodiments shown in the figures.

The cross-sectional area of the bracket part 4 in a plane normal to a central axis of a first hole may correspond to the form of the slot 11 in the support plate 10 of the second support part 8.

In the arrangement the second support part 8 of at least one bracket 1 of said at least two brackets 1 is preferably, but not necessarily, provided with a first anchoring means 29.

In the arrangement the second support part 8 of at least one bracket 1 of said at least two brackets 1 may, as in the embodiment shown in the figures, comprise two parallel identical plate parts 17. In the embodiment shown in the figures each plate part 17 have a rectangular shape and a first end side 18, a second end side 19, a first side 20, a second side 21, a first side surface 22, and a second side surface 23. In the embodiment shown in the figures the support plate 10 is fastened to the first end side 18 of each plate part 17. In the embodiment shown in the figures the second support part 8 is partly open between the two parallel identical plate parts 17 to create a kind of beam of open cross section. If the second support part 8 comprise two parallel identical plate parts 17, as shown in the figures, the second support part 8 may comprise at least one first anchoring means 29 in the form of a U-shaped anchoring member fastened between the plate parts 17 so that said U-shaped anchoring member is fastened to the first side surface 22 of each plate part 17 and so that said at least one U-shaped anchoring member extends beyond the first side surface 22 of each plate part 17 from the structure formed by the plate parts 17.

If the second support part 8 of at least one bracket 1 of said at least two brackets 1 in the arrangement comprises two parallel identical plate parts 17, as shown in the figures, the second support part 8 may, as shown in the figures, comprise a second plate part 24 for connecting said two parallel identical plate parts 17. Such second plate part 24 is fastened to the first side 20 of each plate part 17, and which second plate part 24 having rectangular or square shape. Such second plate part 24 may be situated at the opposite end of the second support part 8 in comparison to the support plate 10, as is shown in the figures.

If the second support part 8 of at least one bracket 1 of said at least two brackets 1 in the arrangement comprises two parallel identical plate parts 17, as shown in the figures, the second support part 8 may, as shown in the figures, comprise a third plate part 26 for connecting said two parallel identical plate parts 17, which third plate is fastened to the plate parts 17 between the first side surface 22s of the two parallel plate parts 17. Such third plate part 26 may have a rectangular or square shape.

The second support part 8 of at least one bracket 1 of said at least two brackets 1 in the arrangement comprises preferably, but not necessarily, as shown in the figures, a housing structure 25 for providing a space for the bracket part 4 in the second support part 8. A purpose of the housing structure 25 is to ensure that a space for the bracket part 4 is provided in the second support part 8 also after that the second support part 8 has been at least partly casted into a precast structural element of concrete.

The first support part 2 of at least one bracket 1 of said at least two brackets 1 in the arrangement comprises preferably, but not necessarily, a plate member 27 and a profile member 28 attached to the plate member 27 for anchoring the first support part 2 to the precast support element 3 of concrete. The treaded holes are preferably, but not necessarily, as shown in the figures, provided in the plate member 27.

The first support part 2 of at least one bracket 1 of said at least two brackets 1 in the arrangement is preferably, but not necessarily, provided with at least one second anchoring means 30 for anchoring the first support part 2 to the precast support element 3 of concrete. In the figures the second anchoring means 30 are in the form of studs with enlarged heads.

The first support part 1, the second support part 2, and the bracket part 4 are preferably, but not necessarily, made of steel.

It is apparent to a person skilled in the art that as technology advanced, the basic idea of the invention can be implemented in various ways. The invention and its embodiments are therefore not restricted to the above examples, but they may vary within the scope of the claims.

The invention claimed is:

1. A bracket for supporting a precast structural element of concrete, the bracket comprising:

a first support part that is configured to be cast at least partly into the support element of concrete, the first support part comprising threaded holes for co-operation with threads of bolts;

a bracket part movably fastened to the first support part by means of bolts, the bracket part comprising first through holes which are penetrated by the bolts, the bolts having an outer diameter that is smaller than an inner diameter of the through holes in the bracket part in order to fasten the bracket part in various positions with respect to the first support part; and a second support part that is configured to be cast at least partly into a precast structural element of concrete and that supports the bracket part, the second support part comprising:

a support plate having a slot with a second support surface that supports the second support part on a first support surface of the bracket part;

two parallel identical plate parts, each plate part having a rectangular shape, and each plate part comprising a first end side, a second end side, a first side, a second side, a first side surface and a second side surface; and at least one first anchoring means in the form of an U-shaped anchoring member, the at least one first anchoring means being fastened between the plate parts so that the at least one U-shaped anchoring member is fastened to the first side surface of each plate part, and extends beyond the first side surface of each plate part, wherein the support plate is fastened to the first end side of each plate part, and the second support part is at least partly open between the two parallel identical plate parts.

2. The bracket according to claim 1, wherein the first support surface and the second support surface have at least partly curved configurations.

3. The bracket according to claim 1, wherein the bracket part comprises a first preformed surface for cooperation with a second preformed surface of the first support part.

4. The bracket according to claim 1, further comprising:

a stopper part for holding the second support part on the bracket part, the stopper part being provided with second through holes penetrated by the bolts in order to fasten the bracket part to the first support part, wherein the bracket part is situated between the stopper part and the first support part.

5. The bracket according to claim 4, wherein a sectional area of the stopper part in a plane normal to a central axis of a second hole is larger than a sectional area of the bracket part in a plane normal to a central axis of a first hole.

6. The bracket according to claim 1, wherein the second support part comprises a housing structure for providing a space for the bracket part in the second support part.

7. The bracket according to claim 1, wherein the first support part being provided with at least one second anchoring means for anchoring the first support part to the precast support element of concrete.

8. An arrangement for supporting a precast slab element of concrete on at least one precast support element, an end of the precast slab element being supported on the at least one precast support element by means of at least two brackets located at a distance from each other, each of the brackets comprising:

a first support part casted that is configured to be casted at least partly into the precast support element, the first support part comprising threaded holes for co-operation with threads of bolts;

a bracket part movably fastened to the first support part by means of the bolts so that the bracket part is at least partly located outside the precast support element, the bracket part comprising first through holes which are penetrated by the bolts, the bolts having an outer diameter that is smaller than an inner diameter of the through holes in the bracket part in order to fasten the bracket part in various positions with respect to the first support part; and a second support part that is configured to be cast at least partly into precast slab element, the second support part comprising:

a support plate having a slot with a second support surface that supports the second support part, the second support part being supported on a first support surface of the bracket part; wherein the second support part of at least one bracket of the at least two brackets further comprises:

two parallel identical plate parts, each plate part having a rectangular shape and a first end side, a second end side, a first side, a second side, a first side surface and a second side surface, the support plate being fastened to the first end side of each plate part, and the second support part being at least partly open between the two parallel identical plate parts; and at least one first anchoring means in the form of an U-shaped anchoring member, the at least one first anchoring means being fastened between the plate parts so that the at least one U-shaped anchoring member is fastened to the first side surface of each plate part, and extends beyond the first side surface of each plate part.

9. The arrangement according to claim 8, wherein at the at least two brackets are located at essentially the same vertical height.

10. The arrangement according to claim 8, wherein the precast slab element is provided with a first vertical flange and with a second vertical flange, and a second support part of one bracket of the at least two brackets being casted at least partly into the first vertical flange of the precast slab element, and a second support part of another bracket of the at least two brackets being casted at least partly into the second vertical flange of the precast slab element.

11. The arrangement according to claim 8, wherein the first support surface and the second support surface of at least one bracket of the at least two brackets have at least partly curved configurations.

12. The arrangement according to claim 8, wherein the bracket part comprises a first preformed surface for cooperation with a second preformed surface of the first support part in at least one bracket of the at least two brackets.

13. The arrangement according to claim 8, wherein at least one bracket of the at least two brackets are provided with a stopper part that holds the second support part on the bracket part, the stopper part is provided with second through holes penetrated by the bolts in order to fasten the bracket part to the first support part, and the bracket part is situated between the stopper part and the first support part.

14. The arrangement according to claim 13, wherein a sectional area of the stopper part in a plane normal to a central axis of a second hole is larger than a sectional area of the bracket part in a plane normal to a central axis of a first hole.

15. The arrangement according to claims 8, wherein the second support part of at least one bracket of said at least two brackets comprises a housing structure for providing a space for the bracket part in the second support part.

16. The arrangement according to claim 8, wherein the first support part of at least one bracket of at the at least two brackets is provided with at least one second anchoring means for anchoring the first support part to the precast support element of concrete.

17. The arrangement according to claim 8, wherein the precast slab element of concrete is a TT-slab element of concrete.

18. The arrangement according to claim 8, wherein the at least one precast support element of concrete is a precast wall element of concrete.

* * * * *